US006127911A

United States Patent [19]

Haller et al.

[11] Patent Number: 6,127,911

[45] Date of Patent: Oct. 3, 2000

[54] TRANSFORMER

[75] Inventors: Hans-Otto Haller, Niedereschach; Gerard Rilly, Unterkirnach; José-I Rodriguez-Duran, Villingen-Schwenningen, all of Germany

[73] Assignee: Deutsche Thomson-Brandt GmbH, Villingen-Schwenningen, Germany

[21] Appl. No.: 09/243,201

[22] Filed: Feb. 2, 1999

[30] Foreign Application Priority Data

Feb. 13, 1998 [DE] Germany ..... 198 05 914
Jul. 31, 1998 [DE] Germany ..... 198 34 615

[51] Int. Cl.[7] ..... H01F 27/29; H01F 27/30

[52] U.S. Cl. ..... 336/192; 336/198; 336/200; 336/232

[58] Field of Search ..... 336/298, 208, 336/192, 200, 232; 29/602.1, 602.23, 602.24, 602.25

[56] References Cited

U.S. PATENT DOCUMENTS

| | | | |
|---|---|---|---|
| 4,641,114 | 2/1987 | Person | 336/200 |
| 4,837,544 | 6/1989 | McDougal | 336/192 |
| 5,010,314 | 4/1991 | Estrov | 336/198 |
| 5,291,173 | 3/1994 | Yerman et al. . | |
| 5,463,365 | 10/1995 | Iwatani et al. | 336/192 |
| 5,598,135 | 1/1997 | Maeda et al. . | |

FOREIGN PATENT DOCUMENTS

| | | |
|---|---|---|
| 001045 | 9/1996 | Austria . |
| 0782154 | 12/1996 | European Pat. Off. . |
| 0782154 | 7/1997 | European Pat. Off. . |
| 2250394 | 7/1973 | Germany . |
| 2233005 | 12/1977 | Germany . |
| 8711808 | 11/1987 | Germany . |
| 3722124 | 2/1988 | Germany . |
| 3731286 | 3/1988 | Germany . |
| 3700488 | 7/1988 | Germany . |
| 4233086 | 4/1993 | Germany . |
| 4337053 | 5/1994 | Germany . |
| 19652039 | 6/1998 | Germany . |
| 2250383 | 6/1992 | United Kingdom . |

OTHER PUBLICATIONS

Power Conversion Intelligent Motion, "1–MHz Resonant Converter Power Transformer is Small, Efficient, Economical," Estrov. pp. 14–24, Aug. 1986, copy in 336–232.

*Primary Examiner*—Thomas J. Kozma
*Attorney, Agent, or Firm*—Joseph S. Tripoli; Joseph J. Laks; Daniel E. Sragow

[57] ABSTRACT

Transformer comprises a core (K1, K2), a primary winding (W1) and at least one secondary winding (W2), which are arranged as conductors on one or more layers of a flat carrier, and a coil former with a chamber system having chambers (C1, C2), which accommodate the layers with the windings (W1, W2). At least one of the chambers (C1, C2) is closed at least in regions, with the result that long distances for creepage paths are obtained. As a result of this, it is possible to adhere to existing safety regulations for the mains power supply isolation even with very compact dimensions and/or with full utilization of the width available for the conductor tracks. The chamber system can be formed from two or three plastic parts (P1, P2, P3) by mating. The layers with the conductor tracks are routed laterally out of the chamber system in order to make contact with terminals. In an advantageous refinement, webs with metallized slots are arranged on walls of the chamber system, in order to make contact with the conductor tracks (L). The slots are, for example, notched or trough-shaped depressions in which the carrier layers latch into place and are held thereby. The electrical contact afforded by the slots can be additionally supported by a solder-paste application with subsequent soldering. The lateral contacts mean that plated-through holes are avoided in the case of the carrier layers, with the result that the latter can be produced significantly more inexpensively. By virtue of the chamber system, it is possible for the openings in a core, for example an E/E or E/I core, to be utilized significantly better if the transformer has to comply with a sufficient insulation strength, such as in the case of mains power supply isolation, for example.

9 Claims, 5 Drawing Sheets

TRANSFORMER

BACKGROUND

The invention is based on a transformer comprising a primary winding and at least one secondary winding, which are arranged in the form of conductor tracks on one or more layers of a flat carrier, in particular films or printed circuit boards. Transformers of this type are used for example in switched-mode power supplies having very high switching frequencies, in particular frequencies of more than 50 kHz, thereby enabling the transformer to be kept very small.

When the transformer is reduced in size, it is necessary to ensure sufficient insulation between the primary side and the secondary side if the transformer is not intended to be potted. This is particularly important for switched-mode power supplies having mains power supply isolation, for which safety regulations demand a creepage path for electric surface currents from the secondary side to the primary side of at least 6 mm, which must be adhered to throughout the entire transformer. With given dimensions of the transformer core, the available useful volume for the windings is thereby restricted. The safety regulations consequently lead to larger components and higher power losses due to increased non-reactive resistance and due to reduced magnetic coupling.

Known transformers of this type, illustrated in FIGS. 1*a,* 1*b,* contain for example a core with two core parts K1, K2, primary and secondary windings W1, W2 being arranged in the openings therein. The windings are arranged as conductor tracks L on non-conductive layers F of a flat carrier, a plurality of layers in each case lying one above the other, depending on the number of turns required. A plurality of layers P are in this case serially interconnected by plated-through holes T2 and have two external terminals T1, T3. In order to achieve sufficiently long creepage paths between the various windings, the outer and inner edges R of the layers P must remain free, in other words are not permitted to have any conductor tracks. The conductor tracks L are produced as copper tracks on the layers P using etching technology, for example. Figures 1*a,* 1*b* are sectional drawings corresponding to a central horizontal and a central vertical plane of the transformer.

The object of the present invention is to specify a compact transformer of the type mentioned in the introduction which has improved electrical properties.

BRIEF SUMMARY OF THE INVENTION

The transformer of the invention comprises a coil former with a chamber system having chambers which accommodate the layers with the windings. The windings are arranged in at least two separate chambers, thereby producing long distances for creepage currents between the windings without the transformer having to be potted. In this case, the chamber system is formed by at least two parts, which are formed in such a way that chambers are produced by mating of these parts.

The chamber system can, for example, be formed by two parts, whose shape in each case corresponds to an asymmetrical H in cross section and which are mated in such a way as to produce one closed chamber in the region of a core opening for the secondary winding and two adjacent, open chambers for the primary winding. In a different exemplary embodiment, the chamber system is formed by three parts, two parts being placed onto a central part in such a way as to produce two closed chambers, one for in each case one winding.

The parts of the chamber system may be produced for example from injection-moulded thermoplastic, and their dimensions are chosen in such a way that they latch together with one another in the course of mating at the outer walls. In this case, the outer walls may lie one above the otherlike a sandwich, thereby producing long distances for creepage currents without necessitating any increase in the space required by the chamber system.

The chamber system surrounds, in particular, the regions and the openings of the core and is open on both sides, with the result that the layers with the windings can be routed out on both sides in order to make contact with terminals and for effecting contacts between different layers. In addition, the outer part of the chamber system is provided with an extension on its outer edge, with the result that the mated parts assume the shape of an H in a section via the core, as a result of which the creepage path is enlarged at these edges. The layers themselves may be sufficiently enlarged at the open sides, as previously, with the result that the safety regulations are likewise adhered to here. The contact-making by the chamber system is not restricted as a result of this.

Although the parts of the chamber system themselves take up part of the space in the openings in the core, this is compensated for since the conductor tracks now extend over the entire width of a layer up to the walls of the chamber system. As a result of this, for example, the utilizable copper area is increased by approximately 45% for a transformer with a transformation power of approximately 140 watts. The electrical power loss is reduced in the same ratio.

In addition, the chambers serve as an assembly aid and reduce the variation in the geometry and, consequently, in the electrical properties on account of assembly tolerances. Alternatively, the power of the transformer can be increased as a result of this or the size of the transformer can be reduced with a predetermined power. The layers are, for example, printed circuit boards or films, for example Mylar or Kapton films.

If carrier layers which are coated on both sides are used, then plated-through holes are necessary, which holes connect conductor tracks arranged on the top side and underside of the carrier layer. In addition, it is necessary to connect conductor tracks of a plurality of carrier layers to one another, since only one or a few conductor tracks are arranged on one side of a carrier layer and a predetermined number of turns must be achieved for a transformer winding. However, this makes this transformer considerably more expensive and makes automatic production more difficult.

In order to make contact with the conductor tracks, the chamber system therefore has, in an advantageous refinement, webs with metallized slots which establish connections between conductor tracks which are arranged on the top side and the underside of a carrier layer coated on both sides, or between conductor tracks of two adjacent carrier layers. This makes it possible, in particular, to avoid plated-through holes of carrier layers. A slot in this case encompasses, like a clamp to a certain extent, the edge of a carrier layer coated on both sides and thereby connects two conductor tracks, in the case of which, for example, one end in each case is led up to this edge.

The webs of the chamber system and the metallized slots can be produced by the two-shot MID ("moulded interconnect devices") process together with the chamber parts. The MID process, a plastic injection-moulding process, makes it possible to produce filigree structures made of thermoplastics together with metallic conductor tracks, which can replace conventional printed circuit boards. The webs are in this case selectively metallized for the production of the slots.

For a lower contact resistance, the metallized slots may additionally be strengthened by electroplating. To afford assistance, it is possible to provide a solder-paste application with a downstream soldering operation. The contacts are distributed between two or more webs in order to ensure an interspace having a sufficient insulation spacing between two slots. In the case of the two-shot MID process, activation by means of palladium nuclei can be used in the first shot, for example, the said activation improving the adhesion of a subsequently applied copper layer.

For the carrier layers it is possible to use, in particular, an LCP (Liquid Crystal Polymer) structure to which conductor tracks can be applied using the Futuron process, for example. This makes it possible to produce conductor track thicknesses with 35 μm or 70 μm of copper for higher current loading, in other words conductor track thicknesses which cannot be produced by the "hot stamping" process. The LCP film is highly temperature-resistant, thereby enabling soldering processes, for example the Reflow process, to be used for the chamber system with the carrier layers arranged therein.

BRIEF DESCRIPTION OF THE DRAWINGS

The invention is explained in more detail below, by way of example, with reference to schematic drawings, in which.

DESCRIPTION OF THE PREFERRED EMBODIMENTS

Figures 1A, 1B:
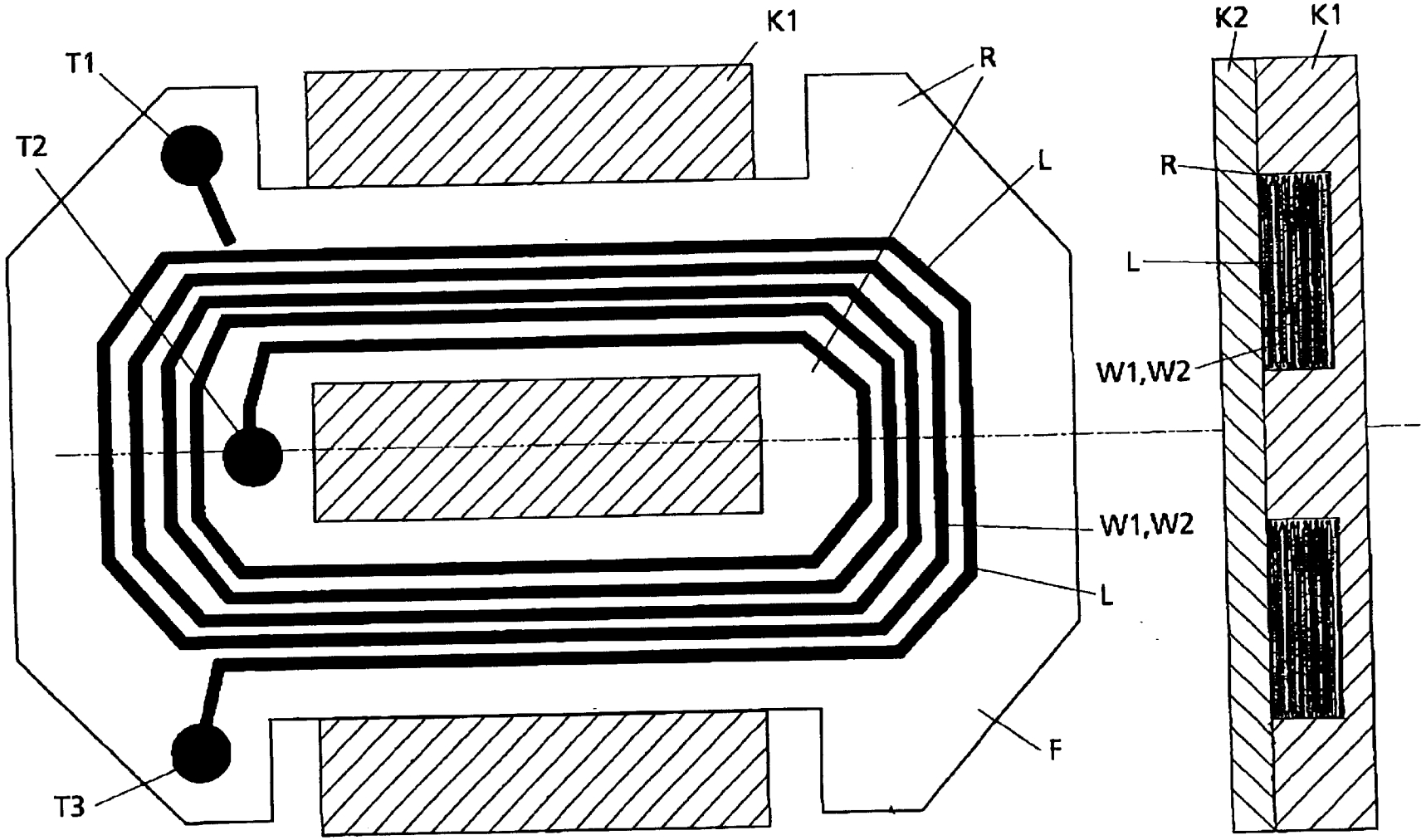
FIGS. 1*a,* 1*b* show a planar transformer according to the prior art.
Figure 2A:
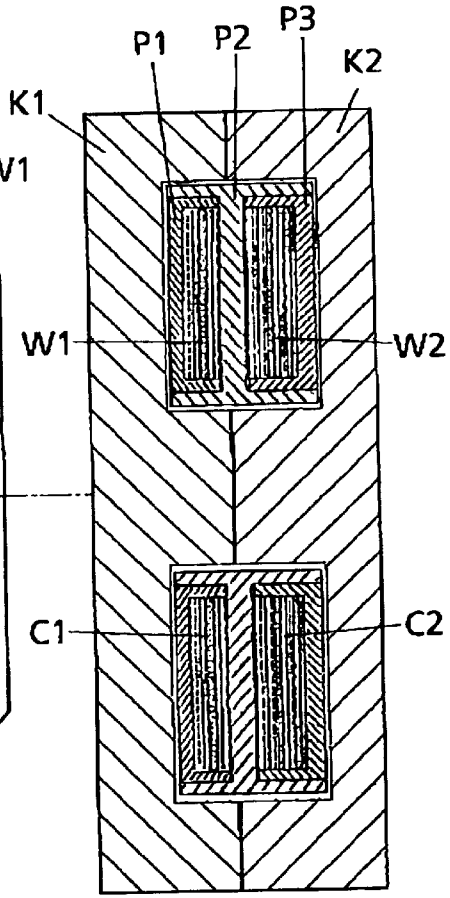
FIGS. 2*a,* 2*b* show a transformer according to the invention with a chamber system made of three parts and two chambers, and FIGS. 3*a,* 3*b* show a transformer according to the invention with a chamber system made of two parts and three chambers.

The transformer illustrated in FIG. 2*a* contains a core having two core parts K1, K2 in the form of an E/E core, the turns of a primary winding W1 and of at least one secondary winding W2 leading through the openings in the said core. The windings W1, W2 are in this case arranged in a chamber system composed of three parts P1, P2, P3 in such a way that two closed chambers C1, C2 are produced in the region of the sectional plane, the windings W1, W2 being arranged separately from one another in the said chambers. One of the parts P2 has the shape of a double-T, referring to an opening, and the other two parts P1, P3 have the shape of a U. The two parts P1, P3 are produced to fit with the central part P2 and are mated with the latter to produce the closed chambers C1, C2. In this case, the U-shaped parts P1, P2 are seated within the T-shaped part P2. Long creepage paths are produced between the two windings W1 and W2 on account of the double-T of the part P2 arranged in the centre.

The windings W1, W2 are constructed from a plurality of wrappings of carrier layers F, between which an insulating layer is arranged. In this exemplary embodiment, the carrier layers F are provided with conductor tracks on both sides. Carrier layers coated on one side can likewise be used, however. An exemplary arrangement of a conductor track L on the carrier layer F can be seen in FIG. 2*b,* where five turns are arranged on one side with a contact T1 at the beginning and a contact T2 at the end of the conductor track. The end of the conductor track T2 is routed via a plated-through hole to the underside of the carrier layer F, on which turns are likewise arranged, and is routed back to the top side again by means of a plated-through hole T3.

Figure 2B:
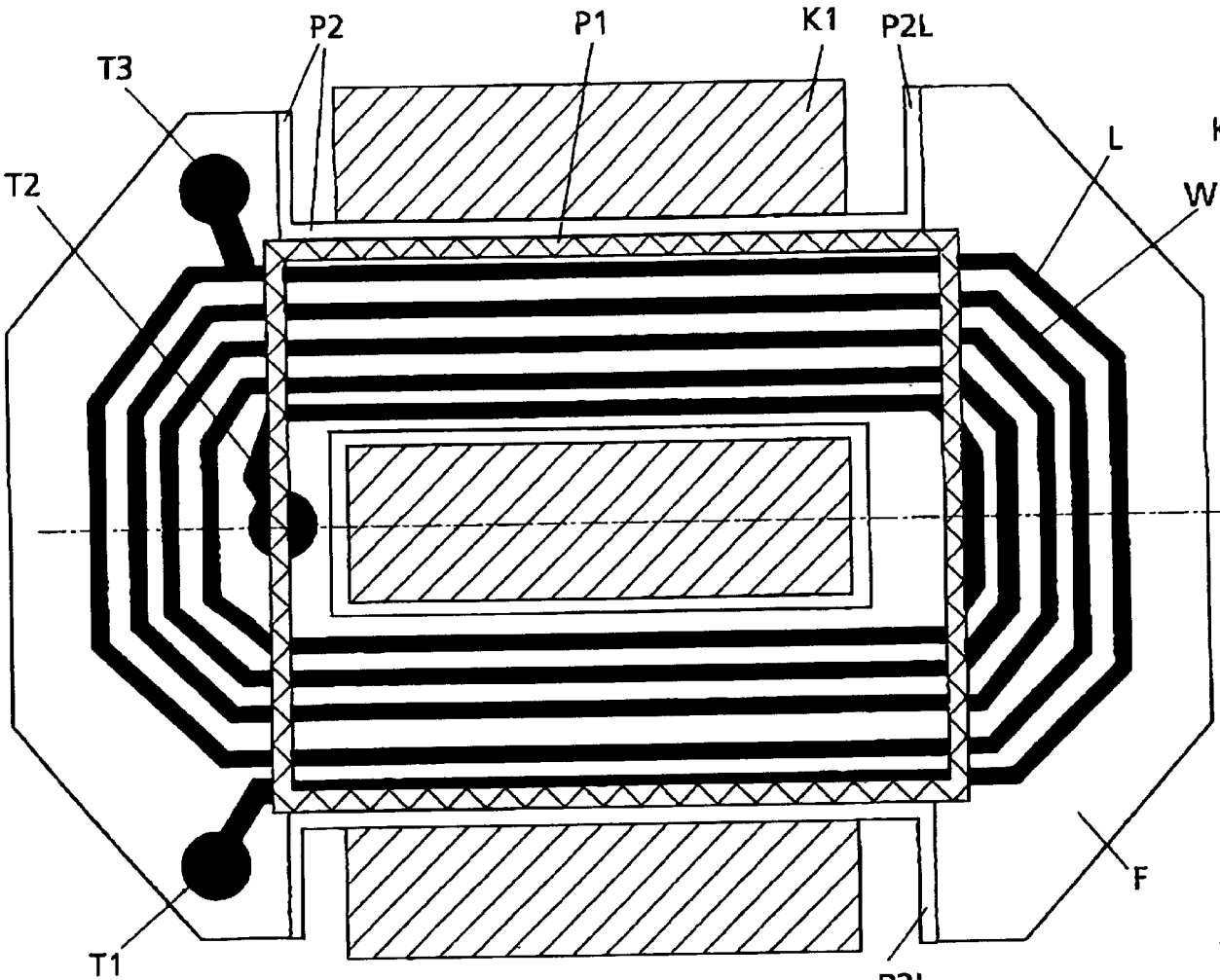

FIG. 2*b* illustrates the transformer of FIG. 2*a* in a sectional plane perpendicular to the sectional plane of FIG. 2*a,* the sectional plane passing through the core part K1. The layers F and the chamber system with the parts P1, P2 completely fill the openings in the core K1. In this case, the chambers of the chamber system are completely closed in the region of the openings in the core and in the core, and only at the two sides on the left and right are the layers F with the conductors L routed out from the chambers C1, C2 for the terminals of the windings W1, W2. The terminals T1, T3 of one winding W1 are located, for example, on the left-hand side and the terminals of the other winding W2 are then located oppositely on the right-hand side, thereby ensuring a sufficient spacing for mains power supply isolation. The double-T-shaped part P2 additionally contains an extension P2L at its edges, for the purpose of enlarging the creepage paths in this region. This arrangement makes it possible for the conductor tracks L to extend over the entire width of the layer F in the region of the core openings.

Figure 3A:
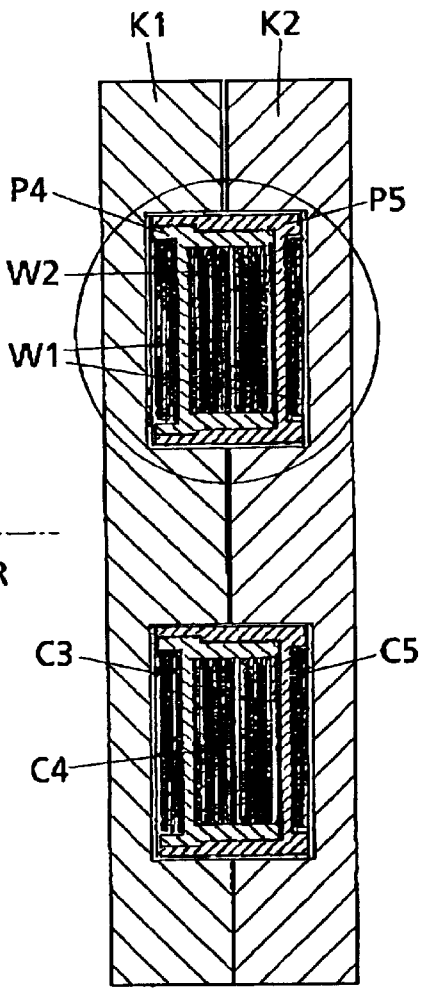

FIGS. 3*a,* 3*b* illustrate a transformer with a chamber system containing an inner part P4 and an outer part P5, which form a closed chamber C4 and two open chambers C3, C5. In the section of FIG. 3*a,* the two parts P4, P5 have the shape of an asymmetrical H, with a slightly different size, so that one can be placed into the other. This allows to arrange the secondary winding W2 in the closed, central chamber C4 and the primary winding W1, divided into two halves, in the two outer chambers C3, C5. The arrangement of the primary winding W1 in the central chamber C4 and of the secondary winding W2 in the two outer chambers C3, C5 is also possible. The shape of the outer walls like an asymmetrical H means that long creepage paths between the windings W1 and W2 are likewise obtained in this case.

Figure 3B:
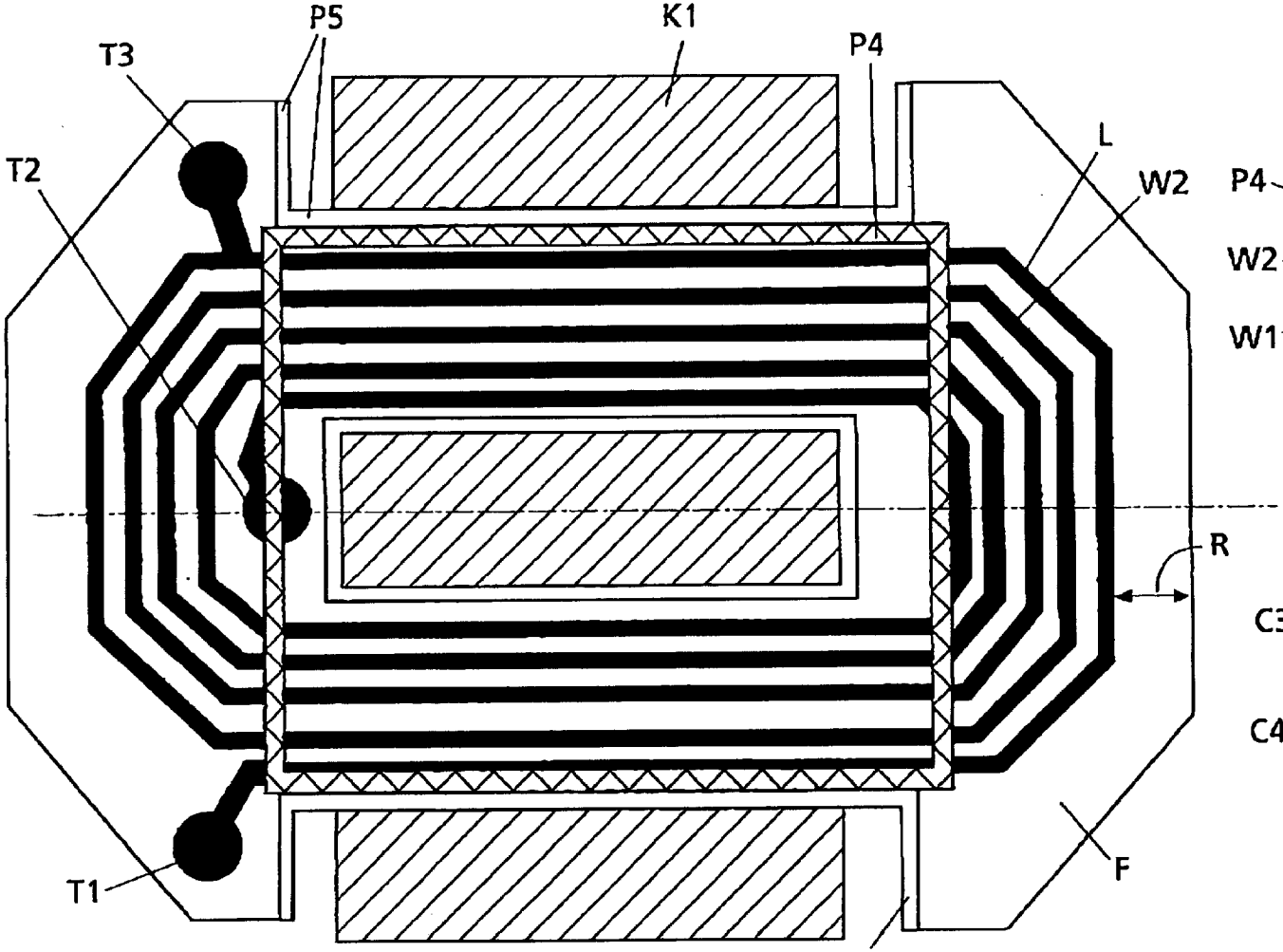

FIG. 3*b* shows the transformer of FIG. 3*a* in a sectional plane corresponding to that of FIG. 2*b.* In this case, the conductor tracks L of a layer F are likewise extended completely over the width of the inner chamber of the part P5. In this case, the chamber system having the parts P4 and P5 is likewise closed only in the region in the core and around the openings therein, and open on both sides for the contact-making of the terminals T1 and T3.

The thickness of the walls of the chamber parts P4 and P5 can be kept very small, for example 0.4 mm. The carrier layers F may protrude from the chamber system outside the openings in the core parts K1, K2, as described above, for example in order to perform contact-making at the terminals T1 and T3. The required insulation spacing can be produced here, without any disadvantages, by a sufficient edge R on the carrier layer F.

The transformer can be used for example in a switched-mode power supply, in which the primary winding W1 is connected to a switching transistor and, via a bridge rectifier, to the mains power supply. A plurality of secondary windings for supplying loads can be arranged both on the secondary side with mains power supply isolation and on the primary side without mains power supply isolation. The mains power supply isolation proceeds on the circuit board on which the transformer is arranged in a device, underneath its core. The question of whether this secondary winding is provided with mains power supply isolation or no mains power supply isolation depends on whether the terminals of a secondary winding are routed out towards the left or towards the right. The windings can be distributed in a corresponding manner between the chambers of the chamber system. However, other configurations, in particular with other core shapes, are likewise possible.

Figure 4:
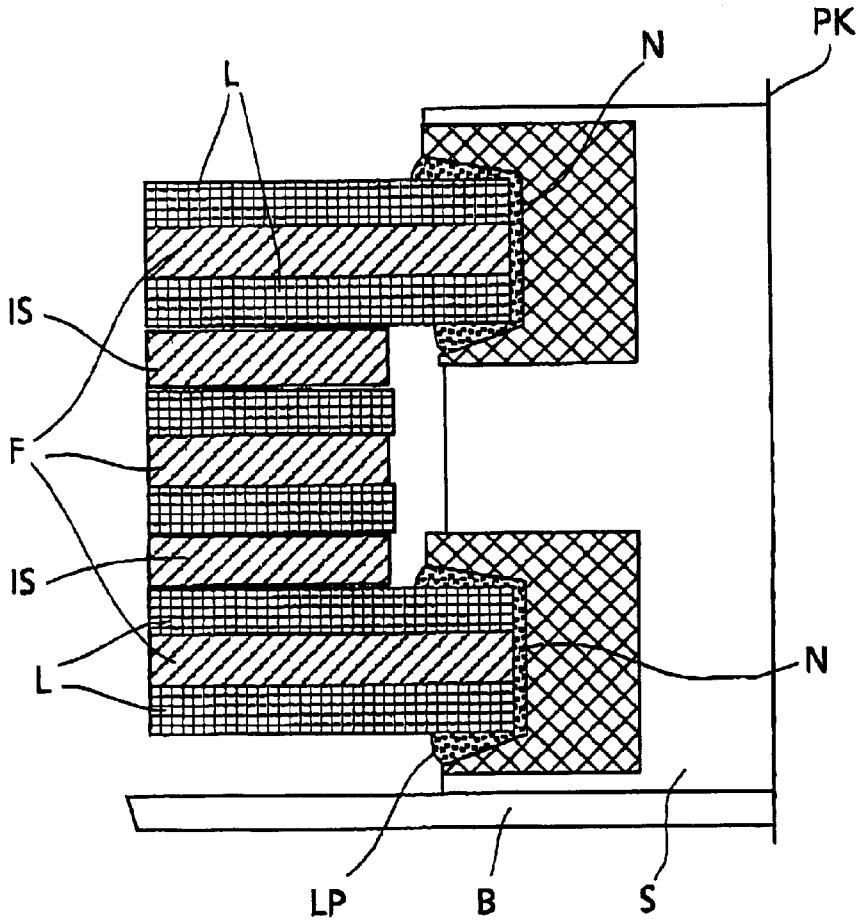
FIG. 4 shows instances of contact-making of conductor tracks by means of trough-shaped slots.

In an advantageous refinement, in order to avoid plated-through holes, the chamber system contains webs S with metallized slots N, illustrated in FIG. 4, which establish connections between conductors L on the top side and the underside of the carrier layers F. The webs S are arranged on chamber walls PK, which rise vertically from the bottom part B of a chamber part in this exemplary embodiment. The slots N may be designed such that they are trough-shaped, as in this exemplary embodiment, or notched, with the result that the carrier layers F latch into place with an edge. In this case, a metallized slot N surrounds the edge like a clamp and thereby establishes electrical contact between a conductor track L on the top side and a conductor track L on the underside of the relevant carrier layer F. The depth of the slot may have values in the region of 0.5 mm, for example.

The carrier layer that is used may be, in particular, an LCP structure having a thickness of 0.05 mm, which can be provided with conductor tracks having a thickness of 35 $\mu$m or 70 $\mu$m. In order to support the contact-making between the conductor tracks L on the top side and underside of the carrier layer F, it is also possible to use, in addition, a solder-paste application LP, which is introduced into the slots N. Appropriate heating, for example in a Reflow process, enables the solder paste to fuse with the conductor tracks L and the metallization layer of the slot N. A conductive adhesive may also be used instead of this soldering process.

Insulating layers IS are arranged between the carrier layers F, in order to avoid short circuits between conductor tracks. In particular, the web S contain a metallized slot N only for every second carrier layer F, thereby producing a sufficient insulation spacing between two slots.

Figure 5B:
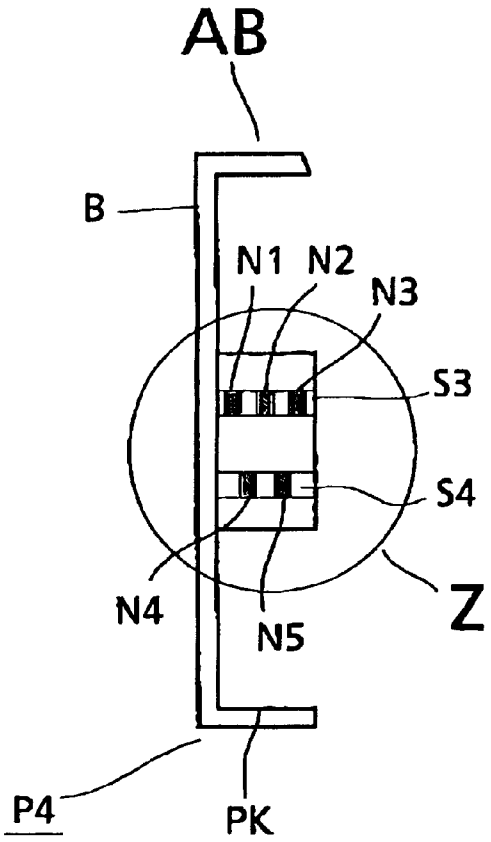
FIG. 5*b* shows a lateral view of the chamber part of FIG. 5*a* in section.
Figure 5A:
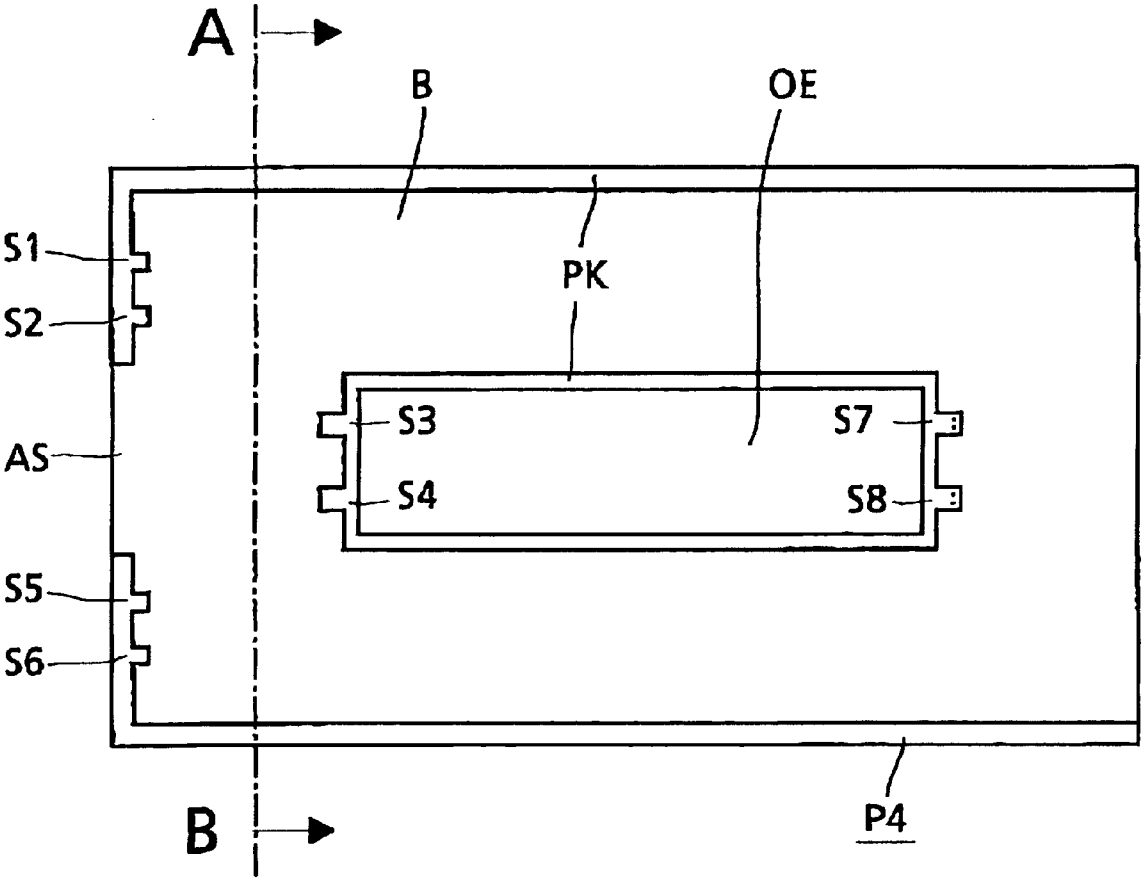
FIG. 5*a* shows a chamber part with webs for contact-making.

FIG. 5*a* illustrates an inner chamber part P4 in a plan view, into which chamber part the carrier layers F, for example the secondary winding W2, are inserted in the form of a stack. The inner chamber part contains a bottom part B, on which the bottommost carrier layer F bears in as planar a manner as possible, and side walls PK, which determine the width of the carrier layers. This chamber part P4 can be used for an E/E core, for example, the central core limb of the core passing through the opening OE in the chamber part P4.

The winding arranged in the chamber part P4 is completely enclosed, in the region of the core and the openings therein, by a second chamber part, not illustrated, thereby making it possible to use the entire width between the chamber walls PK for conductor tracks on the carrier layers F. The chamber part P4 and the associated, terminating outer chamber part are similar to the chamber parts P4 and P5 of FIG. 3*a,* but have lateral extensions. As a result of this, it is possible to arrange further webs in the inner chamber part P4, the webs S1, S2 and S5, S6 in the exemplary embodiment of FIG. 5*a.* The webs S3 and S4 can also be processed from the side through a cutout AS.

The structure of the webs S3, S4 is revealed by FIG. 5*b,* which shows a view of the chamber part P4 in the section A–B. Metallized slots N1–N5 have been worked into these webs S3, S4, which slots in each case establish contact between a conductor track on the top side and the underside of a carrier layer. Since the slots N1–N5 are distributed between two webs, a sufficient insulation space in between the slots is produced. As a result of this, one web is used in each to effect contact with next-but-one carrier layers, with the result that two webs are sufficient. For example, upper and lower conductor tracks of five carrier layers make contact with one another by means of the five slots N1–N5, in order to avoid plated-through holes.

The webs S3, S4 only establish contacts of conductor tracks on the top side and underside of carrier layers, in order to avoid plated-through holes. Contacts between carrier layers can likewise be established by the invention but, in this embodiment, are intended to be realized on the outer edge of the carrier layers together with the terminals of the winding.

Figure 6:
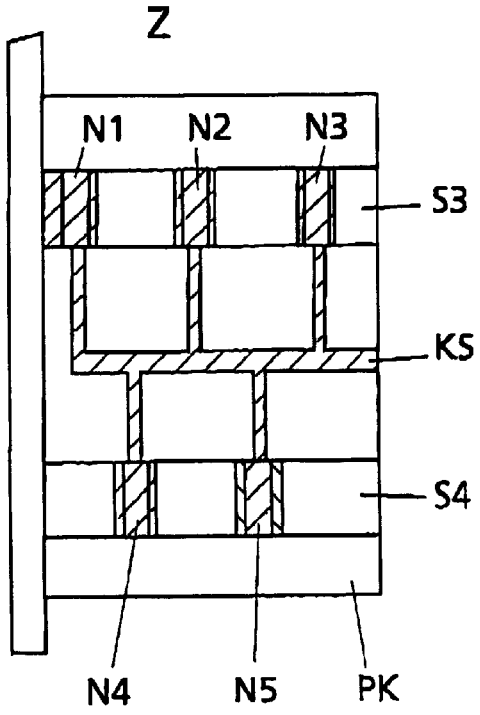
FIG. 6 shows a copper structure for electroplating slots on a chamber part.

FIG. 6 illustrates the slots N1–N5 of the webs S3, S4 in an enlarged manner in a detail drawing. A copper structure KS, which is not present in FIG. 5*b,* can additionally be seen here. This copper structure effects electrical connection to the slots N1–N5, by means of which the metallization of the slots N1–N5 can be reinforced by electroplating in a copper bath during production. The copper track KS is removed again after the electroplating. The copper layer KS can be applied directly on the wall PK.

By using the same LCP structure for the carrier layers F and the chamber parts P4, P5 and/or for the parts P1–P3, it becomes possible for the transformer to be completely recycled. Separation of plastic and metal with a satisfactory degree of purity in the case of an LCP structure have already been demonstrated. Material recycling would be important in particular for television sets, since they contain a very large number of plastic parts.

On account of the outstanding injection-moulding properties of the LCP structures, it is possible to use wall thicknesses in the region of 0.4 mm for the chamber parts, as a result of which the area loss in the openings in the core is kept low with this wall thickness. The widening of the utilizable area on the carrier layers in comparison with earlier transformers enables the number of wrappings of carrier layers to be reduced, with the result that the additional costs arising due to the chamber system can be compensated for just by the saving of a winding wrapping. In addition, the transformer has improved electrical properties due to better utilization of the core openings.

The chamber system which has been explained with reference to FIGS. 2–6 relates essentially to an E/E core or E/I core. However, other configurations, in particular for other core shapes, are likewise possible. Transformers of this type may be used for example in resonant converter switched-mode power supplies which provide relatively high power outputs in the region of considerably more than 100 watts, for example for plasma television sets or television sets having large picture tubes.

What is claimed is:

1. Transformer comprising:

a core, a primary winding and at least one secondary winding which are arranged as conductor tracks on flat carrier layers, and a coil former with a chamber system accommodating said layers with the windings and comprising at least two chambers in which said windings are arranged, the primary and the secondary winding being arranged in different chambers, characterized in that webs with metallized slots are arranged in said coil former in order to make contact with said conductor tracks, said slots providing connections of conductor tracks being arranged at the top side and underside of a double sided carrier layer, and a slot encompasses an edge of a carrier layer, which is coated on both sides, in a clamp-like manner for the purpose of contact-making between said conductor tracks.

2. Transformer according to claim 1, characterized in that said slots are distributed between at least two of said webs with said contact-making being alternatively distributed, for a sufficient insulation spacing between two of said slots.

3. Transformer according to claim 1, characterized in that said webs are arranged on side walls of said coil former, and in that said carrier layers are latched by in each case one of their edges in, in each case, one of said slots.

4. Transformer according to claim 1, characterized in that said parts of said coil former are composed of injection-moulded thermoplastic.

5. Transformer according to claim 4, characterized in that said webs are produced by a two-shot MID process with selective metallization.

6. Transformer according to claim 1, characterized in that said carrier layers are predominantly made of a plastic with an LCP structure, and in that the same plastic is used for said coil former.

7. Transformer according to claim 2, characterized in that the parts of said chamber system surround the openings in said core.

8. Transformer according to claim 7, characterized in that said coil former comprises two parts, which are formed in such a way that three chambers, one inner chamber and two neighbouring chambers, are produced by mating of the parts, and that said inner chamber is closed in the region of said core.

9. Transformer according to claim 7, characterized in that said coil former comprises three parts, which are mated in such a way as to produce two chambers closed in the region of said core, one for said primary winding and one for at least one secondary winding.

* * * * *